US005748086A

United States Patent [19]

Bettine et al.

[11] Patent Number: 5,748,086

[45] Date of Patent: May 5, 1998

[54] ELECTRONIC ARTICLE SURVEILLANCE SYSTEM WITH COMB FILTERING AND FALSE ALARM SUPPRESSION

[75] Inventors: Dale R. Bettine, Coral Springs; Thomas J. Frederick, Coconut Creek, both of Fla.

[73] Assignee: Sensormatic Electronics Corporation, Boca Raton, Fla.

[21] Appl. No.: 639,691

[22] Filed: Apr. 29, 1996

Related U.S. Application Data

[63] Continuation-in-part of Ser. No. 557,628, Nov. 14, 1995, abandoned.

[51] Int. Cl.[6] ..... G08B 13/14

[52] U.S. Cl. ..... 340/572; 340/506

[58] Field of Search ..... 340/572, 506

[56] References Cited

U.S. PATENT DOCUMENTS

| | | | |
|---|---|---|---|
| 4,524,350 | 6/1985 | Eccleston | 340/572 |
| 4,660,025 | 4/1987 | Humphrey | 340/572 |
| 4,859,991 | 8/1989 | Watkins et al. | 340/572 |
| 5,103,234 | 4/1992 | Watkins et al. | 343/742 |
| 5,387,900 | 2/1995 | Plonsky et al. | 340/572 |

*Primary Examiner*—Thomas Mullen

*Attorney, Agent, or Firm*—Robin, Blecker, Daley and Driscoll

[57] ABSTRACT

A signal received in an electronic article surveillance system is comb-filtered to remove interference. A second comb-filtering function is provided to detect occasions when the first comb-filtering generates ringing artifacts in response to impulsive noise. Alarm indications are inhibited at times when the artifacts due to impulsive noise are detected. Bandwidths of the filtering functions are adjustable in response to operator input.

18 Claims, 5 Drawing Sheets

ELECTRONIC ARTICLE SURVEILLANCE SYSTEM WITH COMB FILTERING AND FALSE ALARM SUPPRESSION

This application is a continuation-in-part of application Ser. No. 08/557,628, filed Nov. 14, 1995 abandoned, which has the same inventors and assignee as this application.

FIELD OF THE INVENTION

This invention is related to electronic article surveillance (EAS) and, more particularly, is concerned with filtering of signals received in EAS systems.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. On the other hand, upon proper payment for the merchandise at a check-out counter, either the marker is removed from the article of merchandise or, if the marker is to remain attached to the article, then a deactivation procedure is carried out which changes a characteristic of the marker so that the marker will no longer be detected at the interrogation zone.

In one type of widely-used EAS system, the electromagnetic field provided at the interrogation zone alternates at a selected frequency and the markers to be detected include a magnetic material that produces harmonic perturbations of the selected frequency on passing through the field. Detection equipment is provided at the interrogation zone and is tuned to recognize the characteristic harmonic frequencies produced by the marker. If such frequencies are present, the detection system actuates an alarm. An EAS system of this type is disclosed, for example, in U.S. Pat. No. 4,660,025 (issued to Humphrey and commonly assigned with the present application).

It is often the case that EAS systems are deployed in locations at which substantial interfering electromagnetic signals are present. In addition to the usual 60 Hz radiation and harmonics generated by the building power system, other interfering signals are likely to be emanated from electronic cash registers, point-of-sale terminals, building security systems, and so forth. The presence of interfering signals can make it difficult to operate EAS systems in a satisfactory manner.

It is well known to adjust EAS systems among settings corresponding to greater or smaller degrees of sensitivity. When a system is adjusted so as to be relatively sensitive, the likelihood of permitting an EAS marker to pass through the interrogation zone undetected is decreased, but at the cost of possibly increasing susceptibility to false alarms. Conversely, if the sensitivity of the system is lowered, the propensity to false alarms is reduced, but the chance that a marker will pass through the interrogation zone undetected may be increased. Thus, adjustment of the EAS system often involves a tradeoff between reliable performance in terms of detecting markers (sometimes referred to as "pick rate") and susceptibility to false alarms. The presence of interfering signals tends to make it difficult to achieve an acceptably high pick rate without also incurring an unacceptable susceptibility to false alarms.

To overcome this problem, it has been known to perform certain signal conditioning or filtering upon the signal received by the detection equipment before that signal is processed to determine whether a marker is present in the interrogation zone. One approach that can be contemplated in terms of signal conditioning is comb band-pass filtering. A comb band-pass filter is designed to pass the harmonic signals generated by the marker, and to attenuate the noise spectrum in between the harmonic frequencies. A conventional multi-rate implementation of a comb filter is schematically illustrated in FIG. 2. The digital comb filter of FIG. 2, generally indicated by reference numeral 20, forms a sequence of input digital samples x[n] into N parallel sample streams at block 22, and the respective sample streams are low-pass filtered at blocks 24 before being synthesized at block 26 into a sequence of output signals y[n].

The impulse-response and frequency-response characteristics of the comb filter of FIG. 2 are respectively illustrated in FIGS. 3 and 4. The frequency-response characteristic of FIG. 4 would be suitable for pre-filtering signals received by the detection portion of an EAS system which employs an operating frequency (f0) of 73.125 Hz, a commonly-used operating frequency in EAS systems. The pass-bands of the comb filter 20 of FIG. 2 are shown in FIG. 4 as corresponding to integral multiples of the operating frequency f0, namely 73.125 Hz, 146.250 Hz, 219.375 Hz, and so forth. It will be observed that the frequency-response characteristic shown in FIG. 4 provides significant attenuation across the frequency spectrum between the transmitter harmonic frequencies, which are integral multiples of the operating frequency f0. Accordingly, good attenuation of interfering signals can be obtained by using a comb filter having this frequency-response characteristic. However, as illustrated by the impulse-response characteristic shown in FIG. 3, the comb filter 20 responds to impulsive noise by "ringing", thereby generating a signal train that lasts for approximately 800 milliseconds. The ringing signal is typically produced in synchronism with the interrogation signal cycle, and therefore, unfortunately, mimics the harmonic perturbations provided by markers. This can lead to false alarms in the EAS system. The signal artifacts generated by the comb filter can be reduced by reducing the steepness of the transition bands, but only at the cost of reducing the effectiveness of the comb filter in removing interference. It would be desirable to provide comb-filtering, with steep transition bands, while preventing the EAS system from incorrectly interpreting the comb filter signal artifacts resulting from noise spikes as marker signals.

OBJECTS AND SUMMARY OF THE INVENTION

It is accordingly an object of the invention to provide an electronic article surveillance system in which signals received from an interrogation zone are comb-filtered to suppress interference.

It is another object of the invention to provide an electronic article surveillance system which employs comb filtering in a manner that does not substantially contribute to susceptibility to false alarms.

It is still another object of the invention to provide an electronic article surveillance system in which signal artifacts created in response to noise spikes by comb filtering are detected and disregarded.

According to an aspect of the invention, there is provided an electronic article surveillance system, including circuitry for generating and radiating an interrogation signal at a predetermined frequency in an interrogation zone, an antenna for receiving a signal present in the interrogation zone, and signal processing circuitry for processing the signal received by the antenna. According to this aspect of the invention, the signal processing circuitry includes a first comb filter for comb-filtering the signal received by the antenna to produce a first filter signal, the first comb filter having a frequency-response characteristic with pass-bands corresponding to integral multiples of the predetermined frequency, a detection circuit for receiving the first filtered signal and for generating a detection signal at times when the first filtered signal indicates that an electronic article surveillance marker is present in the interrogation zone, a second comb filter for comb-filtering the signal received by the antenna to produce a second filtered signal, the second comb filter having a frequency-response characteristic with pass-bands corresponding to odd integral multiples of one-half of the predetermined frequency, and inhibit circuitry, responsive to the first and second filtered signals, for selectively inhibiting the detection circuit from generating the detection signal. All of the two comb filters, the detection circuit, and the inhibit circuitry may conveniently be realized by means of a single, suitably programmed, digital signal processing integrated circuit.

Further in accordance with this aspect of the invention, the inhibit circuitry may include a first squaring circuit for processing the first filtered signal to form a first energy signal, a second squaring circuit for processing the second filtered signal to form a second energy signal, a first low-pass filter for low-pass filtering the first energy signal to form a first filtered energy signal, a second low-pass filter for low-pass filtering the second energy signal to form a second filtered energy signal, and a comparison circuit for comparing the respective levels of said first and second filtered energy signals.

Further in accordance with this aspect of the invention, the predetermined operating frequency of the generating and radiating circuitry may be substantially 73.125 Hz, in which case the pass-bands of the first comb filter are centered at 73.125 Hz and other integral multiples of that frequency, while the pass-bands of the second comb filter are centered at 36.5625 Hz, 109.6875 Hz, 182.8125 Hz and other odd integral multiples of 36.5625 Hz.

Further, the system may include a selection circuit for selecting a bandwidth for the pass-bands of the first comb filter, and also for selecting a corresponding bandwidth for the pass-bands of the second filter.

The provision of the anti-comb filter, and processing of the comb and anti-comb filter signals to detect correspondence in the respective energy levels of those signals, makes it possible to inhibit the detecting circuitry from issuing a false alarm in response to signal artifacts created by the comb filter ringing in response to impulsive noise. As a consequence, a comb filter having desirable properties such as steep transition bands can be employed to improve the overall performance of the EAS system without causing false alarms due to ringing artifacts generated by the comb filter.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
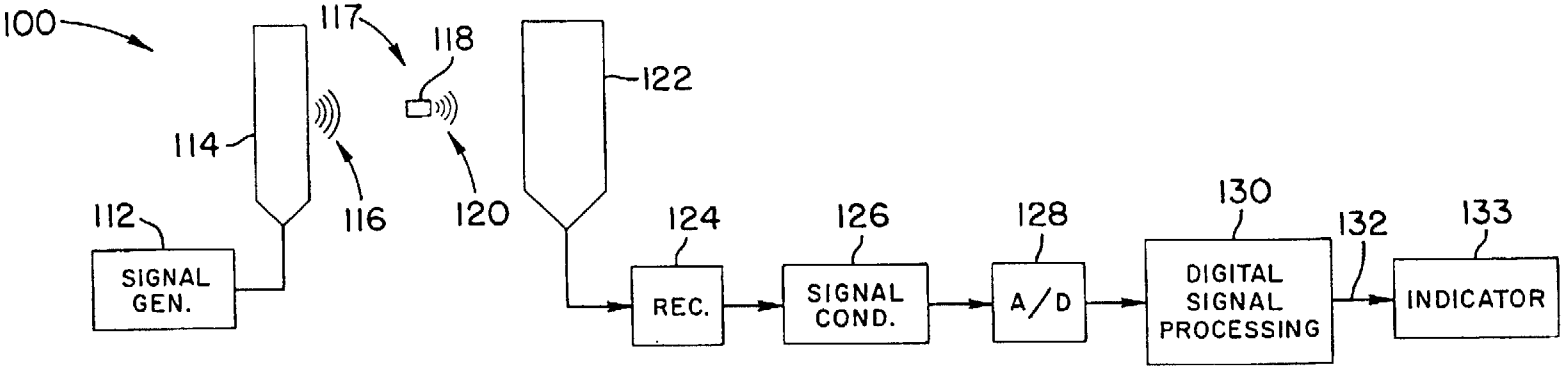
FIG. 1 is a schematic block diagram of an electronic article surveillance system in which comb-filtering is employed with suppression of false alarms in accordance with the present invention.

FIG. 1 illustrates in schematic block diagram form an electronic article surveillance system 100 in which the present invention is embodied.

EAS system 100 includes a signal generating circuit 112 which drives a transmitting antenna 114 to radiate an interrogation field signal 116 into an interrogation zone 117. An EAS marker 118 is present in the interrogation zone 117 and radiates a marker signal 120 in response to the interrogation field signal 116. The marker signal 120 is received at a receiving antenna 122 along with the interrogation field signal 116 and various noise signals that are present from time to time in the interrogation zone 117. The signals received at the antenna 122 are provided to a receiving circuit 124, from which the received signal is provided to a signal conditioning circuit 126. The signal conditioning circuit 126 performs analog signal conditioning, such as analog filtering, with respect to the received signal. For example, the signal conditioning circuit 126 may perform high-pass filtering with a cutoff frequency of about 600 Hz to remove the interrogation field signal 116, power line radiation, and low harmonics thereof. The signal conditioning circuit may also include a low-pass filter to attenuate signals above, say, 8 kHz, which is beyond the band which includes harmonic signals of interest.

The conditioned signal output from the signal conditioning circuit 126 is then provided to an analog-to-digital converter 128, which converts the conditioned signal into a digital signal. The resulting digital signal is then provided as an input signal to a digital signal processing device 130.

The DSP device 130 processes the input digital signal in a manner that will be described below. On the basis of such processing, the DSP device 130 determines whether a marker 118 seems to be present in the interrogation zone, and if so, the device 130 outputs a detection signal 132 to an indicator device 133. The indicator device 133 responds to the detection signal 132 by, for example, generating a visible and/or audible alarm or by initiating other appropriate action.

According to a preferred embodiment of the invention, each of the elements 112, 114, 118, 122, 124, 126 and 133 may be of the types used in a known EAS system marketed by the assignee of the present application under the trademark "AISLEKEEPER". The DSP circuit 130 may be realized, for example, by a conventional DSP integrated circuit such as the model TMS-320C31 floating point digital signal processor, available from Texas Instruments. The A/D converter 128 is also preferably of a conventional type.

Figure 5:
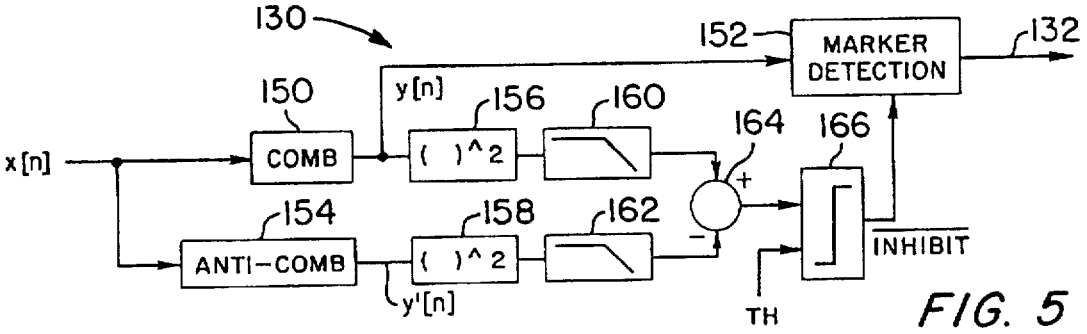
FIG. 5 illustrates in schematic block form signal processing functions carried out in a digital signal processing circuit that is part of the EAS system of FIG. 1.

FIG. 5 illustrates in schematic form signal processing functions carried out in the DSP circuit 130. It will be understood that the processing to be described is carried out under the control of a stored program which controls the operations of the DSP circuit 130. (The program memory in which the program is stored is not separately shown.) The purpose of the processing illustrated in FIG. 5 is to detect whether an active marker 118 is present in the interrogation zone 117.

Figure 2:
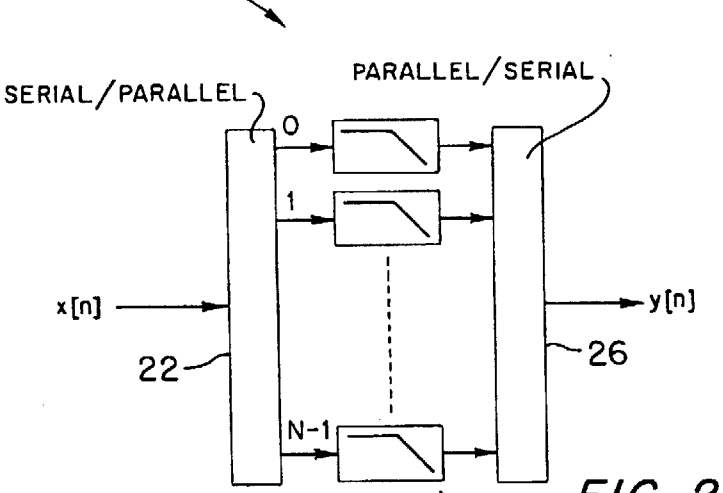
FIG. 2 (PRIOR ART)
FIG. 2 is a schematic illustration of a conventional digital implementation of a comb filter.

Referring to FIG. 5, the DSP 130 initially performs a first comb filtering function 150, like that described in connection with FIGS. 2–4, upon the sequence of digital input signals x[n], thereby producing a sequence of output signals y[n]. In particular, the multi-rate comb filter as shown in FIG. 2 may be implemented with N=256, corresponding to a sampling rate of 18.72 kHz (=256 ×f0).

The resulting output signals y[n] are then subjected to marker detection processing indicated at block 152 according to conventional techniques. If it is determined at block 152 that the output signal sequence y[n] is indicative of the presence of a marker signal 120 in the interrogation zone 117, then the block 152 generates the detection signal 132.

Figure 6:
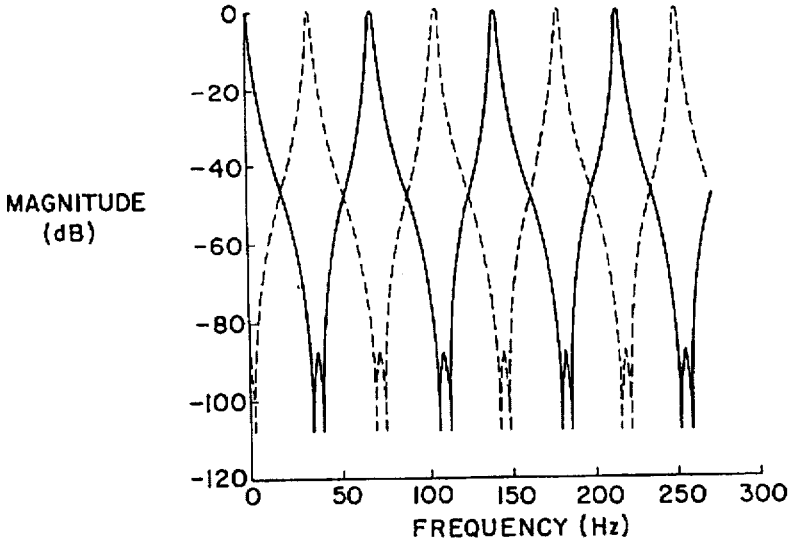
FIG. 6 graphically illustrates the respective frequency-response characteristics of first and second comb filtering processes carried on as part of the processing of FIG. 5.

The input signals x[n] are also subjected to a second comb filtering function 154 (also referred to as "anti-comb filtering"). The anti-comb filtering 154 has a frequency-response characteristic like that of the first comb filtering 150, except that the pass-bands of the anti-comb filtering are positioned halfway in between the pass-bands of the first comb filtering 150. This is illustrated in FIG. 6, in which the frequency-response characteristic of the anti-comb filtering is indicated by the dashed-line trace, while the frequency-response characteristic of the first comb filtering is indicated by a solid line trace. It will be noted that the pass-bands of the anti-comb filtering function 154 are at odd integral multiples of one half of the operating frequency f0, that is, at 35.5625 Hz, 109.6875 Hz, 182.8125 Hz, and so forth.

Programming the DSP device 130 to perform the above described first and second comb filtering functions is well within the ability of those who are skilled in the art. For example, suitable filtering functions can readily be defined using the well-known "MATLAB" software tool-kit.

Figure 7:
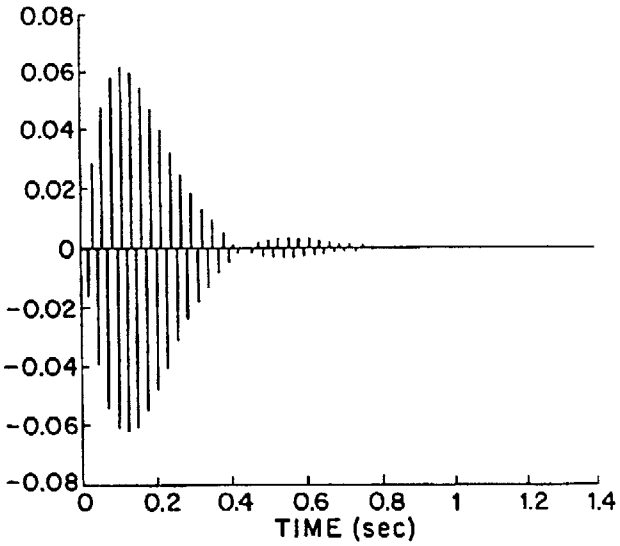
FIG. 7 is a graphic representation of an impulse-response characteristic of the second comb filtering process of FIG. 5.
Figure 9:
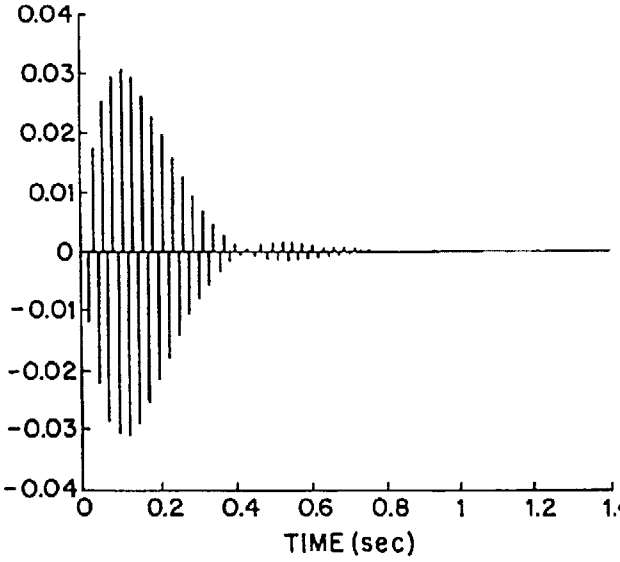
FIG. 9 is a graphic representation of a step response characteristic of the second filtering process of FIG. 5.
Figure 8:
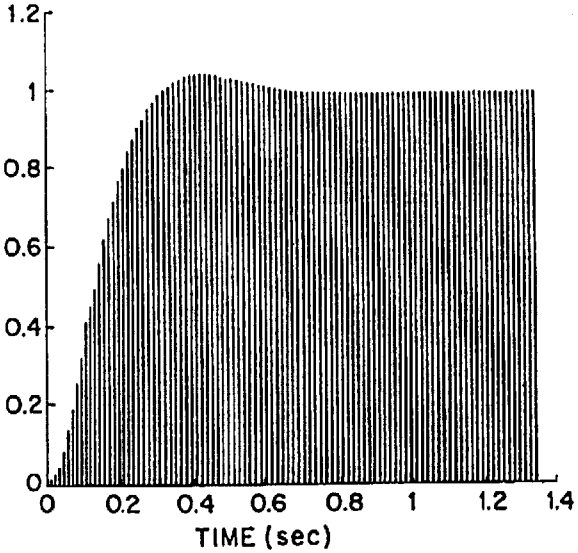
FIG. 8 is a graphic representation of a step response characteristic of the first comb filtering process of FIG. 5.

The impulse-response characteristic of the anti-comb filtering is illustrated in FIG. 7, which shows that the impulse response of the anti-comb filtering is the same as the impulse response of the comb filtering (FIG. 3), except that, in the anti-comb impulse response, every other sample is inverted. Moreover, the respective total energy outputs of the filtering functions 150 and 154, generated in response to a single impulse, are the same. On the other hand, as illustrated in FIGS. 8 and 9, the respective step-response characteristics of the first comb filtering function 150 and the anti-comb filtering function 154 are quite different. In particular, FIG. 8 illustrates the step response of the comb filtering function 150, which is the response provided by the function 150 when a marker signal 118 is present, while FIG. 9 illustrates the step response (marker signal response) of the anti-comb filtering function 154.

The subsequent processing illustrated in FIG. 5 makes use of the substantially identical energy outputs of the two filtering functions in response to impulsive noise to inhibit the production of false alarm indications that would otherwise be produced by the response of the comb filtering function 150 to impulsive noise. Specifically, and referring again to FIG. 5, the output signal sequence y[n] produced by the comb filtering function 150 is provided to a first squaring function 156, while the output signal sequence y'[n] provided by the anti-comb filtering function 154 is provided to a second squaring function 158. The first and second squaring functions 156 and 158 respectively produce first and second energy signal sequences, which, in turn, are respectively low-pass filtered at LPF functions 160 and 162. The first filtered energy signal output by the LPF function 160 and the second filtered energy signal output from the LPF function 162 are provided as inputs to a subtraction block 164, which subtracts the second filtered energy signal from the first filtered energy signal to produce a difference signal. The difference signal is then compared with a predetermined threshold level TH at a thresholding function block 166. The block 166 provides an active-low signal $\overline{\text{INHIBIT}}$ in accordance with the result of the comparison. That is, when the difference between the respective energy outputs of the two comb filters is less than the predetermined threshold level TH, the block 166 outputs a low level signal, and in response to the low level signal, the marker detection function 152 is inhibited from producing the detection signal 132.

Figure 3:
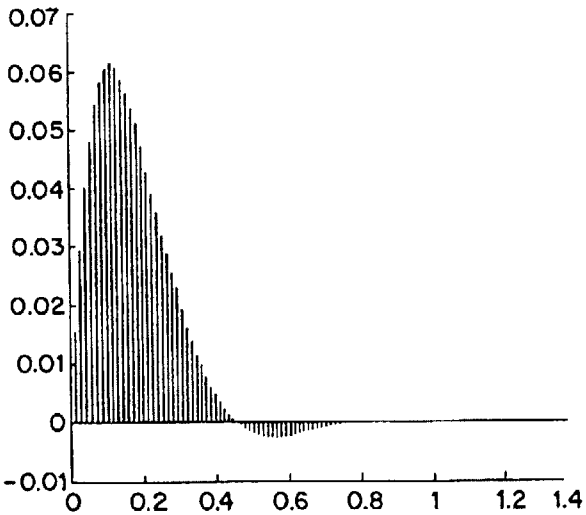
FIG. 3 (PRIOR ART)
FIG. 3 is a graphic representation of an impulse-response characteristic of the comb filter of FIG. 2.
Figure 4:
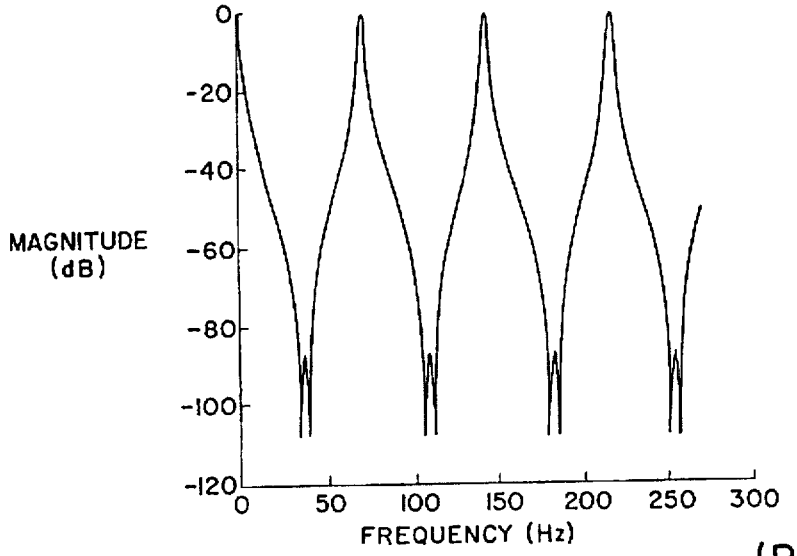
FIG. 4 (PRIOR ART)
FIG. 4 is a graphic representation of a frequency-response characteristic of the comb filter of FIG. 2.

To summarize operation of the system, when a noise spike is present in the signal received at the antenna 122 (FIG. 1), the comb and anti-comb filtering functions 150 and 154 (FIG. 5) produce their respective impulse responses shown in FIGS. 3 and 7, and the resulting, substantially equal energy signals are provided to the subtraction block 164 so that a relatively low level difference signal is provided to the thresholding block 166. As a result, the signal $\overline{\text{INHIBIT}}$ is output at a low level by block 164, thereby inhibiting the marker detection function 152 from generating the detection signal 132.

On the other hand, when a marker signal 120 is present in the signal received by the receiving antenna 122, the comb and anti-comb filtering functions 150 and 154 generate their respective step responses shown in FIGS. 8 and 9. As a result, the energy signal provided by the channel corresponding to the comb filtering function 150 is, after a short time (on the order of 0.3 to 0.4 seconds) much larger than the energy signal provided by the channel corresponding to the anti-filtering function 154. Therefore, a relatively large difference signal is provided by the subtraction block 164 to the thresholding function 166. The $\overline{\text{INHIBIT}}$ signal is therefore at a high level, so that the marker detection function 152 is allowed to generate the detection signal 132 in response to its detection of the marker signal.

In short, the channel corresponding to the anti-comb filtering function 154 is provided to detect occasions when the comb filter 150 is "ringing" in response to a noise impulse, and at such times, false alarms that would otherwise be produced in response to the comb filter ringing are inhibited. Consequently, the comb filter 150 can be provided with steep transition bands to provide strong attenuation of noise between the operating frequency harmonics, without significantly increasing the susceptibility of the system to false alarms.

Although not indicated in FIG. 5, it is contemplated to perform other digital signal conditioning in DSP device 130 in addition to the comb filtering function 150 described above. For example, DSP device 130 may perform high- and/or low-pass filtering in place of the filtering function(s) performed at analog signal conditioning circuit 126. Contrariwise, it is also contemplated to perform the signal processing of FIG. 5 by means of analog circuitry, rather than by means of a digital signal processor.

Figure 5A:
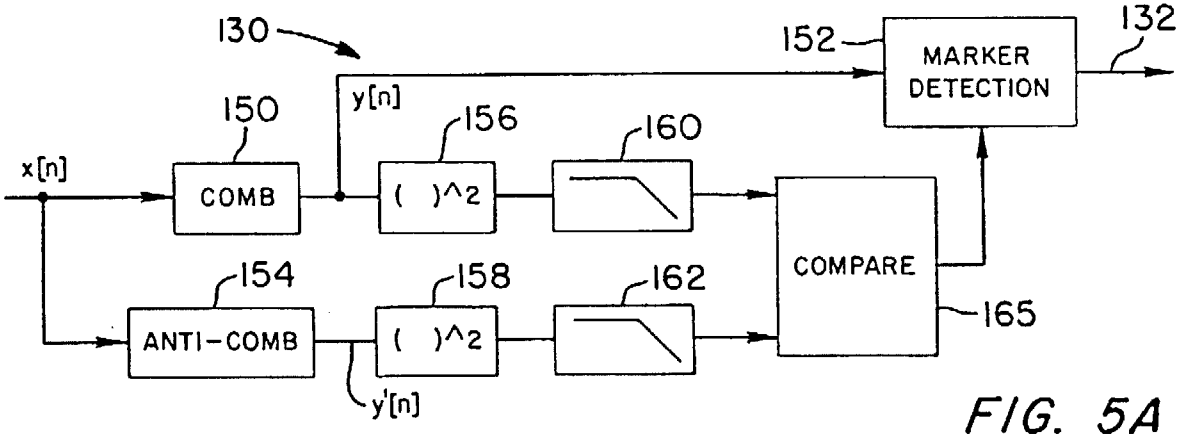
FIG. 5A illustrates a somewhat generalized alternative form of the processing functions of FIG. 5.

FIG. 5A illustrates a somewhat generalized form of the processing described above in connection with FIG. 5. All of the processing blocks of FIG. 5 are duplicated in FIG. 5A, except that the processing carried out in blocks 164 and 166 of FIG. 5 are represented by a comparison block 165 in FIG. 5A, which operates on the respective outputs of blocks 160 and 162. Although the comparison performed at block 165 may be performed as indicated in connection with FIG. 5, a preferred embodiment of the invention employs a somewhat different approach in order to achieve greater robustness in the event of variations in absolute signal level. According to this approach, rather than subtracting the "anti-comb" output energy level from the comb output energy level and then comparing the difference to a threshold, a ratio of the two energy levels is compared to a threshold. A computationally convenient algorithm calls for multiplying the threshold by the anti-comb output (output of block 162), subtracting the resulting product from the comb output (output of block 160), and then comparing the resulting difference with zero. Another feasible alternative includes applying logarithm functions respectively to the outputs of blocks 160 and 162, calculating the difference between the resulting values, and comparing the difference with a threshold.

Figure 10:
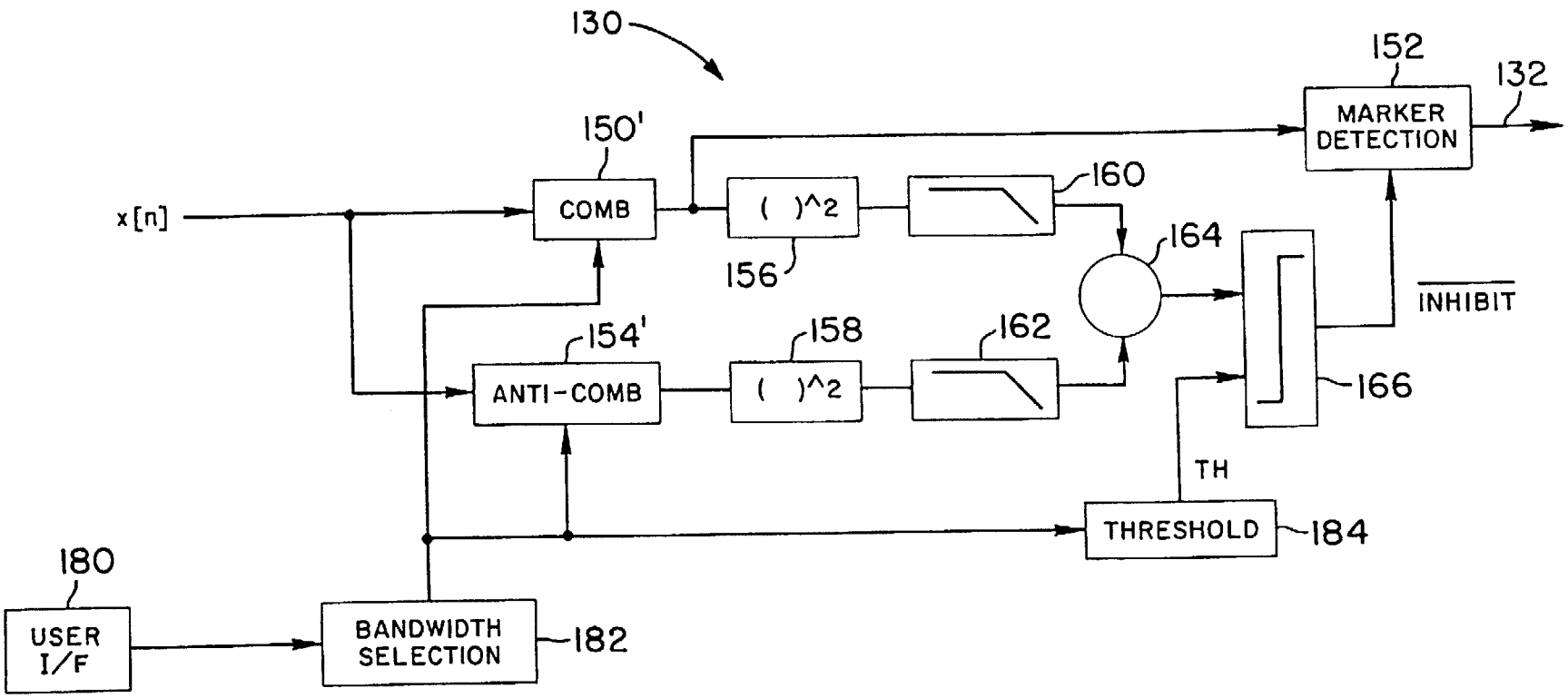
FIG. 10 illustrates in schematic block form signal processing functions carried out in the digital signal processing circuit of FIG. 1 according to a second embodiment of the invention.

FIG. 10 illustrates processing carried out in the DSP 130 in accordance with a second embodiment of the invention, in which a human operator is permitted to change the bandwidth of the pass-bands of the comb filtering function in order to make tradeoffs between the system's response time and its sensitivity to interference. In the processing illustrated in FIG. 10, a user interface device 180 is provided to allow the user to generate a control signal. The control signal is provided to a bandwidth selection function 182 which operates on the basis of the control signal to provide selection signals respectively to comb filtering function 150', anti-comb filtering function 154' and threshold level selection function 184. Both the comb and anti-comb filtering functions 150' and 154' are like the comb filtering functions illustrated in FIG. 5, except that the respective frequency-response characteristics of the comb filtering functions in FIG. 10 are adjustable to narrow or expand the width of the pass-bands of the comb filtering functions. In particular, the comb filtering function 150' is operable to provide a pass-band bandwidth in accordance with the selection signal provided by the bandwidth selecting function 182, and the anti-comb filtering function 154' responds to the selection signal to provide a pass-band bandwidth for the anti-comb filtering function that corresponds to the selected bandwidth of the comb filtering function 150'. Moreover, the threshold level selection function 184 responds to the bandwidth selection signal to provide a threshold level that is suitable for the bandwidths selected for the comb and anti-comb filtering functions.

Figure 10A:
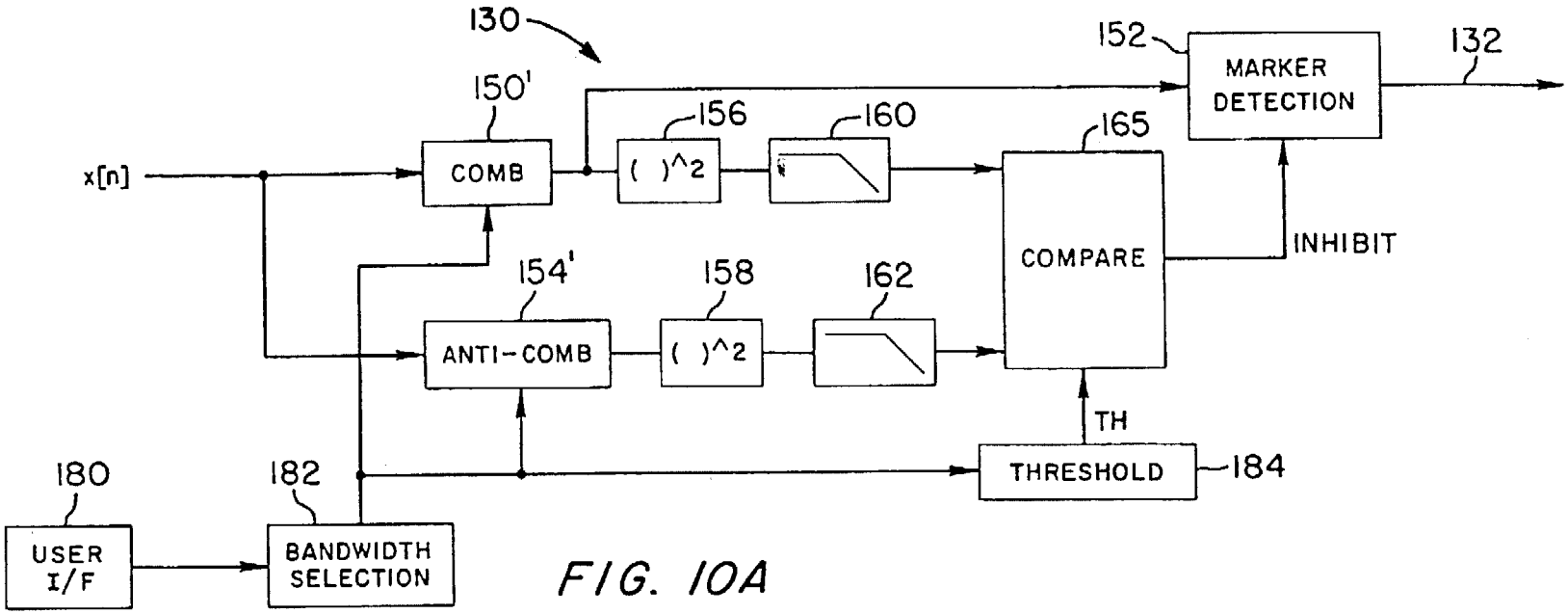
FIG. 10A illustrates a somewhat generalized alternative form of the processing functions of FIG. 10.

FIG. 10A is a generalized representation of the processing described in connection with FIG. 10. In FIG. 10A, a comparison block 165, such as was discussed in connection with FIG. 5A, replaces the blocks 164 and 166 of FIG. 10. Thus, the processing represented by FIG. 10A contemplates comparison of the comb and anti-comb channel outputs in terms of a difference, a log difference, or a ratio (or by other suitable techniques), and by reference to a threshold that varies according to user input.

Various changes in the foregoing apparatus and modifications in the described practices may be introduced without departing from the invention. The particularly preferred methods and apparatus are thus intended in an illustrative and not limiting sense. The true spirit and scope of the invention is set forth in the following claims.

What is claimed is:

1. An electronic article surveillance system, comprising:

means for generating and radiating an interrogation signal at a predetermined frequency in an interrogation zone;

antenna means for receiving a signal present in the interrogation zone; and signal processing means for processing the signal received by the antenna means, the signal processing means including:

first comb filter means for comb-filtering the signal received by the antenna means to produce a first filtered signal;

detection means for receiving the first filtered signal and for generating a detection signal at times when the first filtered signal indicates that an electronic article surveillance marker is present in the interrogation zone;

second comb filter means for comb-filtering the signal received by the antenna means to produce a second filtered signal, the second comb filter means having a frequency-response characteristic different from a frequency-response characteristic of said first comb filter means; and inhibit means, responsive to said first and second filtered signals, for selectively inhibiting the detection means from generating the detection signal.

2. An electronic article surveillance system according to claim 1, wherein said frequency-response characteristic of said first comb filter means has pass-bands corresponding to integral multiples of said predetermined frequency; and said frequency-response characteristic of said second comb filter means has pass-bands corresponding to odd integral multiples of one-half of said predetermined frequency.

3. An electronic article surveillance system according to claim 2, wherein said inhibit means includes:

first squaring means for processing said first filtered signal to form a first energy signal;

second squaring means for processing said second filtered signal to form a second energy signal;

first low-pass filter means for low-pass filtering said first energy signal to form a first filtered energy signal;

second low-pass filter means for low-pass filtering said second energy signal to form a second filtered energy signal; and comparison means for comparing respective levels of said first and second filtered energy signals.

4. An electronic article surveillance system according to claim 3, further comprising selection means for selecting a bandwidth for the pass-bands of said first comb filter means, said selection means also selecting a bandwidth, corresponding to said first comb filter means bandwidth, for the pass-bands of said second filter means.

5. An electronic article surveillance system according to claim 2, wherein said predetermined frequency is substantially 73.125 Hz, said pass-bands of said first comb filter means correspond to integral multiples of 73.125 Hz, and said pass-bands of said second comb filter means correspond to odd integral multiples of 36.5625 Hz.

6. An electronic article surveillance system, comprising:

means for generating and radiating an interrogation signal at a predetermined frequency in an interrogation zone;

antenna means for receiving a signal present in the interrogation zone;

analog-to-digital conversion means for converting the signal received by the antenna means into a digital signal; and processing means for performing digital signal processing with respect to the digital signal formed by the analog-to-digital conversion means, said processing means being programmed to:

perform first comb filtering on said digital signal to produce a first filtered signal;

apply marker detection processing to said first filtered signal to generate a detection signal at times when the first filtered signal is indicative of an electronic article surveillance marker being present in the interrogation zone;

perform second comb filtering on said digital signal to produce a second filtered signal, the second comb filtering having a frequency-response characteristic different from a frequency-response characteristic of said first comb filtering; and compare respective characteristics of said first and second filtered signals to determine whether generation of said detection signal should be inhibited.

7. An electronic article surveillance system according to claim 6, wherein said respective characteristics of said first and second filtered signals are respective energy levels of said first and second filtered signals.

8. An electronic article surveillance system according to claim 6, wherein said frequency-response characteristic of said first comb filtering has pass-bands corresponding to integral multiples of said predetermined frequency; and said frequency-response characteristic of said second comb filtering has pass-bands corresponding to odd integral multiples of one-half of said predetermined frequency.

9. An electronic article surveillance system according to claim 8, further comprising selection means for entering a selection signal indicative of a desired bandwidth for the pass-bands of said first comb filtering, said processing means being responsive to said selection signal so as to perform said first and second comb filtering in accordance with the desired bandwidth indicated by said selection signal.

10. An electronic article surveillance system according to claim 8, wherein said predetermined frequency is substantially 73.125 Hz, said pass-bands of said first comb filtering correspond to integral multiples of 73.125 Hz, and said pass-bands of said second comb filtering correspond to odd integral multiples of 36.5625 Hz.

11. An electronic article surveillance system according to claim 6, wherein said processing means comprises a digital signal processing integrated circuit.

12. A method of performing electronic article surveillance, comprising the steps of:

generating and radiating an interrogation signal at a predetermined frequency in an interrogation zone;

receiving a signal present in the interrogation zone;

first comb-filtering the received signal to produce a first filtered signal;

second comb-filtering the received signal to produce a second filtered signal, the second comb-filtering having a frequency-response characteristic different from a frequency response characteristic of said first comb-filtering;

comparing respective characteristics of said first and second filtered signals; and in dependence upon a result obtained at said comparing step, performing marker detection processing with respect to said first filtered signal to determine whether an electronic article surveillance marker is present in the interrogation zone.

13. A method according to claim 12, wherein said frequency-response characteristic of said first comb-filtering has pass-bands corresponding to integral multiples of said predetermined frequency; and said frequency-response characteristic of said second comb-filtering has pass-bands corresponding to odd integral multiples of one-half of said predetermined frequency.

14. A method according to claim 13, wherein said predetermined frequency is substantially 73.125 Hz, said pass-bands of said first comb-filtering correspond to integral multiples of 73.125 Hz, and said pass-bands of said second comb-filtering correspond to odd integral multiples of 36.5625 Hz.

15. A method according to claim 13, further comprising the step of selecting a desired bandwidth for the pass-bands of said first and second comb-filtering steps from among a plurality of predetermined bandwidths.

16. A method according to claim 12, wherein said respective characteristics of said first and second filtered signals are respective energy levels of said first and second filtered signals.

17. A method according to claim 16, wherein said comparing step includes forming a ratio of the respective energy levels of said first and second filtered signals.

18. A method according to claim 16, wherein said comparing step includes calculating a difference between the respective energy levels of said first and second filtered signals.

* * * * *